US008618986B2

(12) United States Patent
Lan et al.

(10) Patent No.: US 8,618,986 B2
(45) Date of Patent: Dec. 31, 2013

(54) ANTENNA DESIGNING METHOD AND DATA CARD SINGLE BOARD OF WIRELESS TERMINAL

(75) Inventors: Yao Lan, Shenzhen (CN); Shuhui Sun, Shenzhen (CN); Ping Lei, Shenzhen (CN); Yi Fan, Shenzhen (CN); Zhitai Zheng, Beijing (CN); Yanping Xie, Shenzhen (CN); Yongling Ban, Shenzhen (CN)

(73) Assignee: Huawei Device Co., Ltd., Shenzhen (CN)

( * ) Notice: Subject to any disclaimer, the term of this patent is extended or adjusted under 35 U.S.C. 154(b) by 198 days.

(21) Appl. No.: 13/290,485

(22) Filed: Nov. 7, 2011

(65) Prior Publication Data

US 2012/0050112 A1 Mar. 1, 2012

Related U.S. Application Data

(63) Continuation of application No. PCT/CN2010/070294, filed on Jan. 21, 2010.

(30) Foreign Application Priority Data

May 8, 2009 (CN) ..... 2009 1 0136610

(51) Int. Cl.
*H01Q 1/38* (2006.01)

(52) U.S. Cl.
USPC ..... 343/700 MS; 343/702

(58) Field of Classification Search
USPC ..... 343/700 MS, 702; 235/492
See application file for complete search history.

(56) References Cited

U.S. PATENT DOCUMENTS 8,203,488 B2 * 6/2012 Soler Castany et al. ..... 343/700 MS
2003/0189519 A1 10/2003 Rutfors et al.

(Continued)

FOREIGN PATENT DOCUMENTS

CN 1423365 A 6/2003
CN 1441977 A 9/2003

(Continued)

OTHER PUBLICATIONS

English Translation of the Written Opinion of the International Searching Authority, issued by International Searching Authority, dated Apr. 29, 2010, in International Application No. PCT/CN2010/070294, (6 pages).

(Continued)

*Primary Examiner* — Tan Ho
(74) *Attorney, Agent, or Firm* — Conley Rose, P.C.; Grant Rodolph; Nicholas K. Beaulieu

(57) ABSTRACT

An antenna designing method and a data single board of a wireless terminal are disclosed. The method provided by the embodiments of the present invention includes: dividing a semi-closed area without other metal wirings on a data card single board of the wireless terminal; and arranging an antenna wiring and a metal coupling piece in the semi-closed area, where the antenna wiring and the metal coupling piece are parallel and overlap one another, a gap exists between the metal coupling piece and the data card single board, and the metal coupling piece is coupled with the data card single board via the gap. An embodiment of the present invention also provides a data card single board of a wireless terminal. According to the embodiments of the present invention, a Specific Absorption Rate (SAR) value of the antenna is reduced, and a working bandwidth of a broadband is realized.

20 Claims, 1 Drawing Sheet

(56) References Cited

U.S. PATENT DOCUMENTS

| | | | | |
|---|---|---|---|---|
| 2006/0017624 | A1 | 1/2006 | Nagano et al. | |
| 2013/0113666 | A1 * | 5/2013 | Orsi et al. | 343/745 |

FOREIGN PATENT DOCUMENTS

| | | | |
|---|---|---|---|
| CN | 1633735 | A | 6/2005 |
| CN | 200969401 | Y | 10/2007 |
| CN | 201114118 | Y | 9/2008 |
| CN | 101276960 | A | 10/2008 |
| CN | 101540432 | A | 9/2009 |
| CN | 101540433 | A | 9/2009 |
| EP | 1359639 | A1 | 11/2003 |
| JP | 2000020646 | A | 1/2000 |
| JP | 2003078321 | A | 3/2003 |
| JP | 2003198410 | A | 7/2003 |
| JP | 2005236534 | A | 9/2005 |
| JP | 2009017284 | A | 1/2009 |
| JP | 2009027291 | A | 2/2009 |
| WO | WO 2010/127565 | A1 | 11/2010 |

OTHER PUBLICATIONS

First Chinese Office Action dated (mailed) Mar. 30, 2012, issued in related Chinese Application No. 200910136610.3 Huawei Technologies Co., LTD.

Foreign Communication From a Counterpart Application, Japanese Application No. 2012-508885, Japanese Office Action dated Jul. 30, 2013, 3 pages.

Foreign Communication From a Counterpart Application, Japanese Application No. 2012-508885, English Translation of Japanese Office Action dated Jul. 30, 2013, 3 pages.

* cited by examiner

ANTENNA DESIGNING METHOD AND DATA CARD SINGLE BOARD OF WIRELESS TERMINAL

CROSS-REFERENCE TO RELATED APPLICATIONS

This application is a continuation of International Application No. PCT/CN2010/070294, filed on Jan. 21, 2010, which claims priority to Chinese Patent Application No. 200910136610.3, filed on May 8, 2009, both of which are hereby incorporated by reference in their entireties.

FIELD OF THE INVENTION

The present invention relates to the field of wireless communication technologies, and in particular, to an antenna designing method and a data card single board of a wireless terminal.

BACKGROUND OF THE INVENTION

When an antenna is designed on a wireless terminal (for example, a data card), the following technical problems exist, including the following. An available space of an antenna area is small; a target bandwidth is broad; and requirements are strict for a short distance test of a Specific Absorption Rate (SAR) value.

The SAR represents an amount of radiation that is allowed to be absorbed by an organism (including a human body) per kilogram, and is a most direct test value denoting an impact of the radiation on the human body. The lower the SAR value is, the smaller the amount of the absorbed radiation is. In a current SAR test specification, when an SAR value is required to be tested, a distance from each face of the data card to a human body torso model for an SAR test should not exceed 5 mm, and the SAR value should not exceed 1.2 mw/1 g. Therefore, it is a problem to be urgently solved to effectively reduce the SAR value without affecting other wireless performance indexes. Meanwhile, wireless communication has more and more requirements on a working bandwidth of the antenna, and it is hoped that an antenna may have multiple operational frequency bands on an ultra-wideband at the same time.

Currently, when the antenna is designed on the data card, built-in antennas in a form of monopole, Inverted-F Antenna (IFA), and Planar Inverted-F Antenna (PIFA) are widely used. The antennas of these forms are generally located at one end of the data card, and a data card single board acts as a "ground" of the antenna, which together constitute a radiator. During the implementation of the present invention, the inventor finds that: in the antenna design in the prior art, in one aspect, the near-field energy of the antenna radiation is concentrated, causing that the SAR value is relatively large; and in another aspect, the antenna bandwidth is limited, which cannot satisfy a growing bandwidth requirement.

SUMMARY OF THE INVENTION

Embodiments of the present invention provide an antenna designing method and a data card single board of a wireless terminal, which can reduce an SAR value of an antenna, and meanwhile, realize a working bandwidth of a broadband.

An embodiment of the present invention provides an antenna designing method of a wireless terminal, including:

dividing a semi-closed area without other metal wirings on a data card single board of a wireless terminal; and arranging an antenna wiring and a metal coupling piece in the semi-closed area, where the antenna wiring and the metal coupling piece are parallel and overlap one another; a gap exists between the metal coupling piece and the data card single board; and the metal coupling piece is coupled with the data card single board via the gap.

An embodiment of the present invention provides a data card single board of a wireless terminal, including:

a semi-closed area, located on the data card single board of the wireless terminal, and having no other metal wirings in the semi-closed area; and an antenna wiring and a metal coupling piece, arranged in the semi-closed area, where the antenna wiring and the metal coupling piece are parallel and overlap one another; a gap exist between the metal coupling piece and the data card single board; and the metal coupling piece is coupled with the data card single board via the gap.

It can be known from the technical solutions provided by the embodiments of the present invention that, the semi-closed area without other metal wirings is divided on the data card single board of the wireless terminal, and the antenna wiring and the metal coupling piece are arranged in the semi-closed area. The data card single board is generally located in the center of the wireless terminal, and at this time, the distance from the antenna wiring to a cover of the wireless terminal is the longest, so that the antenna is kept away from a human body torso model for an SAR test to the utmost extent, thereby reducing the SAR value. Since it is designed that the antenna wiring and the metal coupling piece are parallel and overlap one another, and the gap exists between the metal coupling piece and the data card single board, the metal coupling piece is coupled with the data card single board via the gap, and multiple resonance points are generated in the gap, so as to realize second coupling between the antenna wiring and the data card single board, thereby realizing the working bandwidth of the broadband. Moreover, the electric field energy coupled by the antenna wiring into the metal coupling piece may be dispersed in the relatively long gap in the gap-coupling manner, which also helps to lower the centralized distribution of the energy and achieves the purpose of reducing the SAR value.

BRIEF DESCRIPTION OF THE DRAWINGS

To illustrate the technical solutions in the embodiments of the present invention more clearly, the accompanying drawings for describing the embodiments or the prior art are introduced briefly in the following. Apparently, the accompanying drawings in the following description are merely some embodiments of the present invention, and persons of ordinary skill in the art may obtain other drawings according to these accompanying drawings without creative efforts.

DETAILED DESCRIPTION OF THE EMBODIMENTS

The technical solutions in the embodiments of the present invention will be described clearly and completely in the following with reference to the accompanying drawings. Apparently, the embodiments to be described are merely a part rather than all of the embodiments of the present invention. All other embodiments obtained by persons of ordinary skill in the art based on the embodiments of the present invention without creative efforts shall fall within the protection scope of the present invention.

Embodiment 1

Figure 1:
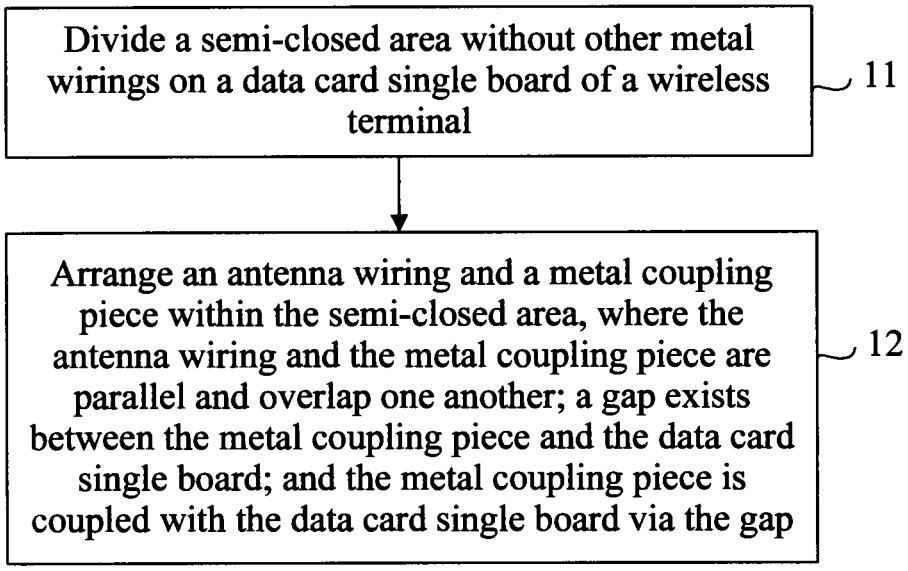
FIG. 1 is a schematic diagram of an antenna designing method of a wireless terminal according to an embodiment of the present invention.

Referring to FIG. 1, an embodiment of the present invention provides an antenna designing method of a wireless terminal, including the following.

Step S11: A semi-closed area without other metal wirings is divided on a data card single board of a wireless terminal.

In the specific implementation, it may be that the semi-closed area is divided on one side of the data card single board, and no other metal components are arranged on a printed broad in the semi-closed area; or, the printed board in the semi-closed area is cut off. The data card single board outside the semi-closed area is configured to arrange the other metal components.

Step S12: An antenna wiring and a metal coupling piece are arranged in the semi-closed area, where the antenna wiring and the metal coupling piece are parallel and overlap one another, a gap exists between the metal coupling piece and the data card single board, and the metal coupling piece is coupled with the data card single board via the gap.

The arranged antenna wiring and metal coupling piece are either printed on the printed board in the semi-closed area or soldered in the semi-closed area. The metal coupling piece is coupled with the antenna wiring by using a non-metal medium or an air medium between printed layers, and the arranged metal coupling piece is isolated from the data card single board by using a non-metal medium (for example, air), where the area distributed with no metal medium is the gap described in the present invention (which is the same hereinafter).

In the antenna designing method of the wireless terminal provided by the embodiment of the present invention, the semi-closed area without other metal wirings is divided on the data card single board of the wireless terminal, and the antenna wiring and the metal coupling piece are arranged in the semi-closed area. The data card single board is generally located in the center of the wireless terminal, and at this time, the distance from the antenna wiring to a cover of the wireless terminal is the longest, so that the antenna is kept away from a human body torso model for an SAR test to the utmost extent, thereby reducing the SAR value. Since it is designed that the antenna wiring and the metal coupling piece are parallel and overlap one another, and the gap exists between the metal coupling piece and the data card single board, the metal coupling piece is coupled with the data card single board via the gap, and multiple resonance points are generated in the gap, so as to realize second coupling between the antenna wiring and the data card single board, thereby realizing a working bandwidth of the broadband. In addition, the electric field energy coupled by the antenna wiring into the metal coupling piece may be dispersed in the relatively long gap in the gap-coupling manner, which also helps to lower the centralized distribution of the energy and achieves the purpose of reducing the SAR value.

In an exemplary design scheme, the semi-closed area may be designed at one end of the data card single board close to a data communication interface of the wireless terminal, for example, at a position close to a Universal Serial Bus (USB) interface, a Personal Computer Memory Card International Association (PCMCIA) interface, an Express interface, or other interfaces, which facilitates the dispersion of the energy on the antenna to a portable device and reduce the SAR value.

The antenna wiring may be designed in a linear distribution with broken lines or curves, and one end of the antenna wiring is connected to an antenna feeder through an antenna matching network. Resonance characteristics of the antenna may be adjusted by adjusting parameters of the antenna matching network.

The metal coupling piece is arranged in the semi-closed area, the metal coupling piece and the antenna wiring are parallel and overlap one another, and the gap exists between the metal coupling piece and the data card single board. In the specific implementation, the metal coupling piece may be printed on an upper layer, a lower layer, or the upper and lower layers of the printed layers where the antenna wiring is located, and the metal coupling piece is coupled with the antenna wiring by using the non-metal medium or the air medium between the printed layers. The shape of the metal coupling piece is adjusted as required, which may be in any regular shape of rectangle, square, circle, rhombus, trapezoid, and triangle, or in an irregular shape. Since the metal coupling piece and the antenna wiring are parallel and overlap one another, the metal coupling piece may be completely insulated from the antenna wiring, or may be conductively connected to the antenna wiring by adding one or more conductive connection points at appropriate positions. Second coupling between the antenna wiring and the data card single board is realized by the metal coupling piece via the gap between the metal coupling piece and the data card single board. In other words, an electric field in the antenna wiring is firstly coupled into the metal coupling piece, and then coupled into the data card single board by the metal coupling piece via the gap.

Optionally, a first antenna matching point is disposed in the gap between the data card single board and the metal coupling piece, where the antenna matching point may be one or a combination of devices such as a capacitor, an inductor, and a resistor. The other end of the antenna wiring is connected to the data card single board via the first antenna matching point. The coupling resonance points between the metal coupling piece and the data card single board may be adjusted by adjusting parameters of the first antenna matching point.

Optionally, at least one second antenna matching point is disposed in the gap between the data card single board and the metal coupling piece, where the antenna matching point may be one or a combination of devices such as a capacitor, an inductor, and a resistor. The coupling resonance points between the metal coupling piece and the data card single board may be further adjusted by adjusting parameters of the second antenna matching point, so that the electric field energy coupled into the metal coupling piece generates multiple resonance points at appropriate positions in the gap.

A radio frequency signal is fed in the antenna through the antenna feeder and the antenna matching network. The resonance characteristics of the antenna may be adjusted by adjusting the parameters of the antenna matching network, optimizing the shape of the antenna wiring, optimizing the shape of the metal coupling piece, and optimizing the gap between the data card single board and the metal coupling piece. In addition, the resonance characteristics of the antenna may be further adjusted by adjusting the parameters of the antenna matching points and the positions of the antenna matching points in the gap, and finally an antenna design with a UWB and a low SAR value working at 800 MHz to 2500 MHz is realized.

Embodiment 2

Figure 2:
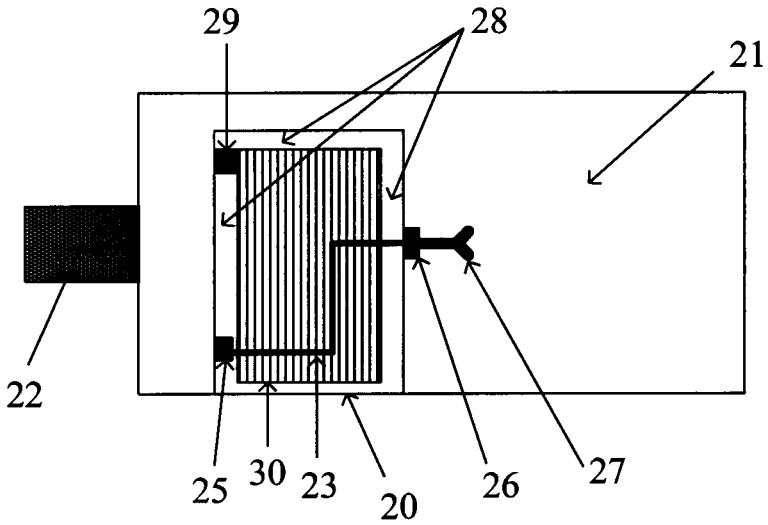
FIG. 2 is a schematic structural diagram of a data card single board of a wireless terminal according to an embodiment of the present invention.

Referring to FIG. 2, a semi-closed area 20 is divided on a part of a data card single board 21 close to a USB interface 22, where the semi-closed area 20 may be in any regular shape of rectangle, square, circle, rhombus, trapezoid, and triangle, or in an irregular shape. The semi-closed area 20 includes: an antenna wiring 23, a metal coupling piece 30, a first antenna matching point 25, a gap 28 between the metal coupling piece and the data card single board, and a second antenna matching point 29. An antenna matching network 26 and an antenna feeder 27 are printed on the data card single board outside the semi-closed area 20. In addition, the antenna matching network 26 is located at an edge position of the semi-closed area 20, and the antenna feeder 27 is connected to one end of the antenna wiring 23 through the antenna matching network 26.

The antenna wiring 23 is in a linear distribution with broken lines or curves, and is printed or soldered in the semi-closed area 20. The antenna wiring 23 and the metal coupling piece are parallel and overlap one another. The other end of the antenna wiring 23 is connected to the data card single board 21 via the first antenna matching point 25.

Since the metal coupling piece 30 and the antenna wiring 23 are parallel and overlap one another, the metal coupling piece 30 may be completely insulated from the antenna wiring 23, or may be conductively connected to the antenna wiring 23 by adding one or more conductive connection points (not shown in FIG. 2) at appropriate positions. In the specific implementation, the metal coupling piece 30 may be printed on an upper layer, a lower layer, or the upper and lower layers of the printed layers where the antenna wiring 23 is located, and the shape of the metal coupling piece 30 may be adjusted with the semi-closed area 20, which may be in any regular or irregular shape. The metal coupling piece 30 is coupled with the antenna wiring 23 by using a non-metal medium or an air medium between the printed layers.

Since the gap exists between the metal coupling piece 30 and the data card single board 21, the metal coupling piece 30 is coupled with the data card single board 21 via the gap. In this way, the antenna wiring 23 firstly couples a part of energy into the metal coupling piece 30, and then the metal coupling piece 30 couples the energy into the data card single board 21 via the gap 28, so as to realize second coupling between the antenna wiring 23 and the data card single board 21.

The semi-closed area 20 is located at a position close to the USB interface 22, which facilitates the dispersion of the energy on the antenna to a portable device. The antenna wiring 23 and the metal coupling piece 30 are arranged in the semi-closed area 20. The data card single board is generally located in the center of the wireless terminal, and at this time, the distance from the antenna wiring 23 to a cover of the wireless terminal is the longest, so that the antenna is kept away from a human body torso model for an SAR test to the utmost extent, thereby reducing the SAR value. Meanwhile, the antenna wiring 23 is coupled with the data card single board 21 through the metal coupling piece 30 via the gap, and multiple resonance points may be generated, so as to realize a working bandwidth of the broadband. In addition, the electric field energy coupled by the antenna wiring into the metal coupling piece may be dispersed in the relatively long gap in the gap-coupling manner, which also helps to lower the centralized distribution of the energy and achieves the purpose of reducing the SAR value.

The second antenna matching point 29 is disposed in the gap between the metal coupling piece 30 and the data card single board 21, where the second antenna matching point 29 may be one or a combination of devices such as a capacitor, an inductor, and a resistor. One or more second antenna matching points 29 may be disposed, and the position in the gap 28 may be adjusted, to adjust the coupling resonance points between the metal coupling piece 30 and the data card single board 21, so that the electric field energy coupled into the metal coupling piece 30 generates multiple resonance points at appropriate positions in the gap.

A radio frequency signal is fed in the antenna wiring 23 by the antenna feeder 27 through the antenna matching network 26. The resonance characteristics of the antenna may be adjusted by adjusting the parameters of the antenna matching network 26, optimizing the shape of the antenna wiring 23, optimizing the shape of the metal coupling piece 30, and optimizing the gap 28 between the data card single board 21 and the metal coupling piece 30. In addition, the resonance characteristics of the antenna may be further adjusted by adjusting the parameters of the antenna matching points (25 and 29) and the positions of the antenna matching points (25 and 29) in the gap 28, and finally an antenna design with a UWB and a low SAR value working at 800 MHz to 2500 MHz is realized.

Embodiment 3

Still referring to FIG. 2, an embodiment of the present invention provides a data card single board 21 of a wireless terminal, and the data card single board 21 includes:

a semi-closed area 20, which is located on the data card single board 21 of the wireless terminal and has no other metal wirings in the semi-closed area 20.

The semi-closed area 20 may be in any regular shape of rectangle, square, circle, rhombus, trapezoid, and triangle, or in an irregular shape.

The antenna wiring 23 and the metal coupling piece 30 are arranged in the semi-closed area 20, where the antenna wiring 23 and the metal coupling piece 30 are parallel and overlap one another, a gap 28 exists between the metal coupling piece 30 and the data card single board, and the metal coupling piece 30 is coupled with the data card single board via the gap 28.

The antenna wiring 23 may be designed in a linear distribution with broken lines or curves, and one end of the antenna wiring 23 is connected to an antenna feeder 27 through an antenna matching network 26. Resonance characteristics of the antenna may be adjusted by adjusting parameters of the antenna matching network 26.

The metal coupling piece 30 is arranged in the semi-closed area 20, and the shape of the metal coupling piece 30 is adjusted as required, which may be in any regular shape of rectangle, square, circle, rhombus, trapezoid, and triangle, or in an irregular shape.

The metal coupling piece 30 and the antenna wiring 23 are parallel and overlap one another, and the two are coupled by using a non-metal medium or an air medium between printed layers. The metal coupling piece 30 may be completely insulated from the antenna wiring 23, or may be conductively connected to the antenna wiring 23 by adding one or more conductive connection points at appropriate positions. A gap 28 exists between the metal coupling piece 30 and the data card single board 21. An electric field in the antenna wiring 23 may be firstly coupled into the metal coupling piece 30, and then coupled into the data card single board by the metal coupling piece 30 via the gap 28, so as to realize second coupling between the antenna wiring 23 and the data card single board 21.

Preferably, the semi-closed area 20 is located at one end of the data card single board 21 close to a data communication interface 22 of the wireless terminal, which facilitates the dispersion of the energy on the antenna to a portable device.

Optionally, the data card single board 21 of the wireless terminal further includes: a first antenna matching point 25, disposed in the gap between the metal coupling piece 30 and the data card single board 21, connected to one end of the antenna wiring 23 and the data card single board 21, and configured to adjust coupling resonance points between the metal coupling piece and the data card single board.

Optionally, the data card single board of the wireless terminal further includes: at least one second antenna matching point 29, disposed in the gap between the metal coupling piece 30 and the data card single board 21, where a position of the second antenna matching point 29 in the gap 28 may be adjusted, so as to adjust the coupling resonance points between the metal coupling piece 30 and the data card single board 21.

The antenna wiring 23 and the metal coupling piece 30 are disposed in the semi-closed area 20. The data card single board 21 is generally located in the center of the wireless terminal, and at this time, the distance from the antenna wiring to a cover of the wireless terminal is the longest, so that the antenna is kept away from a human body torso model for an SAR test to the utmost extent, thereby reducing the SAR value. Meanwhile, the metal coupling piece 30 is coupled with the data card single board 21 via the gap 28, so that the electric field energy coupled by the antenna wiring 23 into the metal coupling piece 30 may generate multiple resonance points with the data card single board via the gap 28, thereby realizing a working bandwidth of the broadband. In addition, the electric field energy in the metal coupling piece 30 may be dispersed in the relatively long gap in the gap-coupling manner, which also helps to lower the centralized distribution of the energy and achieves the purpose of reducing the SAR value.

In conclusion, in the embodiments of the present invention, the semi-closed area without other metal wirings is divided on the data card single board, and the semi-closed area only includes design elements such as the antenna wiring, the metal coupling piece, and the gap. The antenna design with a UWB and a low SAR value is finally realized by optimizing the shape of the semi-closed area and the design elements in the semi-closed area.

The above specific embodiments are not intended to limit the present invention. For persons of ordinary skill in the art, any modification, equivalent replacement, or improvement made without departing from the principle of the present invention should fall within the protection scope of the present invention.

What is claimed is:

1. A wireless terminal antenna designing method, comprising:

dividing a semi-closed area without other metal wirings on a data card single board of a wireless terminal; and arranging an antenna wiring and a metal coupling piece in the semi-closed area, wherein the antenna wiring and the metal coupling piece are parallel and overlap one another, wherein a gap exists between the metal coupling piece and the data card single board, wherein the metal coupling piece is coupled with the data card single board via the gap, wherein the antenna wiring is in a linear distribution, wherein a first antenna matching point is disposed in the gap between the metal coupling piece and the data card single board, and wherein one end of the antenna wiring is connected to the data card single board via the first antenna matching point.

2. The wireless terminal antenna designing method according to claim 1, further comprising adjusting coupling resonance points between the metal coupling piece and the data card single board by adjusting a matching component value or a position of the first antenna matching point.

3. The wireless terminal antenna designing method according to claim 1, wherein the semi-closed area is located at one end of the data card single board close to a data communication interface of the wireless terminal.

4. The wireless terminal antenna designing method according to claim 3, wherein the data communication interface of the wireless terminal comprises a Universal Serial Bus interface, a Personal Computer Memory Card International Association interface, or an Express interface.

5. The wireless terminal antenna designing method according to claim 1, wherein another end of the antenna wiring is connected to an antenna feeder through an antenna matching network.

6. A wireless terminal antenna designing method, comprising:

dividing a semi-closed area without other metal wirings on a data card single board of a wireless terminal; and arranging an antenna wiring and a metal coupling piece in the semi-closed area, wherein the antenna wiring and the metal coupling piece are parallel and overlap one another, wherein a gap exists between the metal coupling piece and the data card single board, wherein the metal coupling piece is coupled with the data card single board via the gap and wherein at least one second antenna matching point is disposed within the gap between the metal coupling piece and the data card single board.

7. The wireless terminal antenna designing method according to claim 6, further comprising adjusting coupling resonance points between the metal coupling piece and the data card single board by adjusting a matching component value or a position of the second antenna matching point.

8. The wireless terminal antenna designing method according to claim 6, further comprising adjusting a resonance point between the metal coupling piece and the data card single board by adjusting parameters of the at least one second antenna matching point.

9. The wireless terminal antenna designing method according to claim 6, wherein the at least one second antenna matching point comprises a capacitor, an inductor, or a resistor.

10. The wireless terminal antenna designing method according to claim 6, further comprising feeding a radio frequency signal to the antenna wiring, wherein the radio frequency signal comprises an 800 to 2500 Megahertz signal.

11. A data card single board of a wireless terminal, comprising:

a semi-closed area located on the data card single board of the wireless terminal and having no other metal wirings in the semi-closed area; and an antenna wiring and a metal coupling piece arranged in the semi-closed area, wherein the antenna wiring the metal coupling overlap one another, wherein a gap exists between the metal coupling piece and the data card single board, wherein the metal coupling piece is coupled with the data card single board via the gap, wherein the semi-closed area is located at one end of the data card single board close to a data communication interface of the wireless terminal, wherein the antenna wiring is in a linear distribution, and wherein a first antenna matching point is disposed in the gap between the metal coupling piece and the data card single board and is configured to connect one end of the antenna wiring to the data card single board.

12. The data card single board according to claim 11, wherein the gap comprises a non-metal medium.

13. The data card single board according to claim 12, wherein the non-metal medium comprises air.

14. The data card single board according to claim 11, wherein the linear distribution comprises broken lines or curves.

15. The data card single board according to claim 11, wherein the antenna wiring is printed or soldered in the semi-closed area.

16. A data card single board of a wireless terminal, comprising:

a semi-closed area located on the data card single board of the wireless terminal and having no other metal wirings in the semi-closed area; and an antenna wiring and a metal coupling piece arranged in the semi-closed area, wherein the antenna wiring and the metal coupling piece are parallel and overlap one another, wherein a gap exists between the metal coupling piece and the data card single board, wherein the metal coupling piece is coupled with the data card single board via the gap, and wherein at least one second antenna matching point is disposed in the gap between the metal coupling piece and the data card single board.

17. The data card single board according to claim 16, wherein the antenna wiring is insulated from the metal coupling piece.

18. The data card single board according to claim 16, wherein the antenna wiring is conductively connected to the metal coupling piece through a conductive connection point.

19. The data card single board according to claim 16, wherein the metal coupling piece is printed on an upper layer, a lower layer, or the upper layer and the lower layer of a printed layer where the antenna wiring is located.

20. The data card single board according to claim 16, wherein a shape of the metal coupling piece comprises a rectangle, a square, a circle, a rhombus, a trapezoid, a triangle, or an irregular shape.

* * * * *

UNITED STATES PATENT AND TRADEMARK OFFICE

CERTIFICATE OF CORRECTION

PATENT NO. : 8,618,986 B2
APPLICATION NO. : 13/290485
DATED : December 31, 2013
INVENTOR(S) : Yao Lan et al.

It is certified that error appears in the above-identified patent and that said Letters Patent is hereby corrected as shown below:

On Title Page 2, References Cited, Item (56) under Other Publications, the following cited art should read:

"First Chinese Office Action dated (mailed) Mar. 30, 2012, issued in related Chinese Application No. 200910136610.3, Huawei Technologies Co., Ltd."

In the Claims

Column 8/Line 28 should read: "card single board via the gap, and"

Column 8/Line 56 should read: "wherein the antenna wiring and the metal coupling piece are parallel and overlap one"

Signed and Sealed this
Eleventh Day of March, 2014

Michelle K. Lee

Michelle K. Lee
*Deputy Director of the United States Patent and Trademark Office*